US010815980B2

(12) United States Patent
Satake et al.

(10) Patent No.: US 10,815,980 B2
(45) Date of Patent: Oct. 27, 2020

(54) VARIABLE DISPLACEMENT SWASH PLATE TYPE COMPRESSOR

(71) Applicant: KABUSHIKI KAISHA TOYOTA JIDOSHOKKI, Aichi (JP)

(72) Inventors: Noriaki Satake, Aichi-ken (JP); Shiro Hayashi, Aichi-ken (JP); Akinobu Kanai, Aichi-ken (JP); Kenji Yamamoto, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 138 days.

(21) Appl. No.: 16/039,897

(22) Filed: Jul. 19, 2018

(65) Prior Publication Data

US 2019/0032648 A1 Jan. 31, 2019

(30) Foreign Application Priority Data

Jul. 28, 2017 (JP) ..... 2017-146139

(51) Int. Cl.

*F04B 27/18* (2006.01)
*F04B 27/10* (2006.01)
*F04B 27/08* (2006.01)

(52) U.S. Cl.

CPC ..... *F04B 27/1804* (2013.01); *F04B 27/10* (2013.01); *F04B 27/1018* (2013.01); *F04B 27/1036* (2013.01); *F04B 27/086* (2013.01); *F04B 27/0839* (2013.01); *F04B 2027/1813* (2013.01); *F04B 2027/1831* (2013.01); *F04B 2201/0804* (2013.01); *F04B 2205/16* (2013.01)

(58) Field of Classification Search

None

See application file for complete search history.

(56) References Cited

U.S. PATENT DOCUMENTS 4,480,964 A * 11/1984 Skinner ..... F04B 27/1036 417/222.2
6,045,337 A * 4/2000 Tokumasu ..... F04B 27/1804 417/213
7,651,321 B2 * 1/2010 Ota ..... F04B 27/1804 417/222.2

(Continued)

FOREIGN PATENT DOCUMENTS

JP 2006-207464 8/2006

*Primary Examiner* — Peter J Bertheaud
*Assistant Examiner* — Geoffrey S Lee
(74) *Attorney, Agent, or Firm* — Greenblum & Bernstein, P.L.C.

(57) ABSTRACT

A variable displacement swash plate type compressor includes a first and a second valve body, and a suction and a bleed window. An open degree of the suction window is minimized by the first valve body and an open degree of the bleed window is maximized by the second valve body when a suction pressure is lower than a predetermined suction pressure and a crank chamber pressure is higher than a control pressure. The open degree of the suction window is increased and the open degree of the bleed window is maximized when the suction pressure is higher than the predetermined suction pressure and the crank chamber pressure is higher than the control pressure. The open degree of the suction window and the open degree of the bleed window are decreased when the crank chamber pressure is lower than the control pressure.

7 Claims, 10 Drawing Sheets

(56) References Cited

U.S. PATENT DOCUMENTS

| | | | | |
|---|---|---|---|---|
| 7,918,656 | B2 * | 4/2011 | Hibino | F04B 27/1804<br>417/222.2 |
| 2009/0223244 | A1 * | 9/2009 | Kimoto | F04B 27/109<br>62/470 |

* cited by examiner

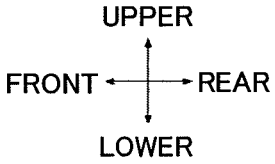
FIG. 5A
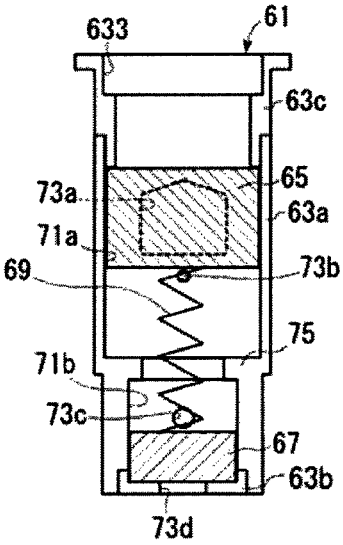
FIG. 5B
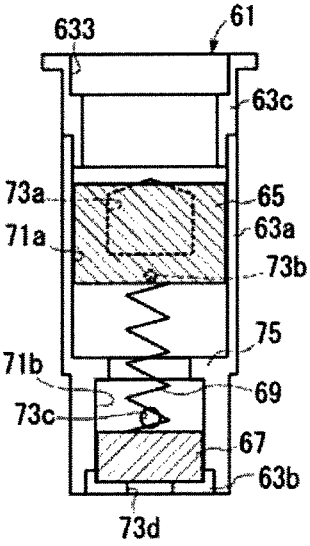
FIG. 5C
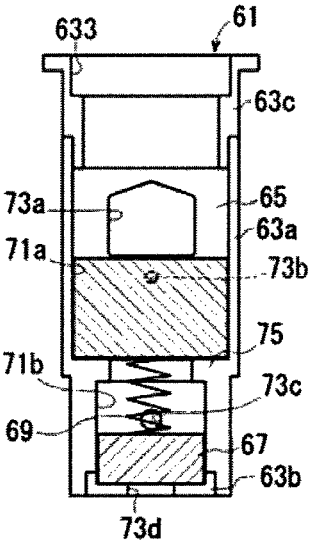
FIG. 5D
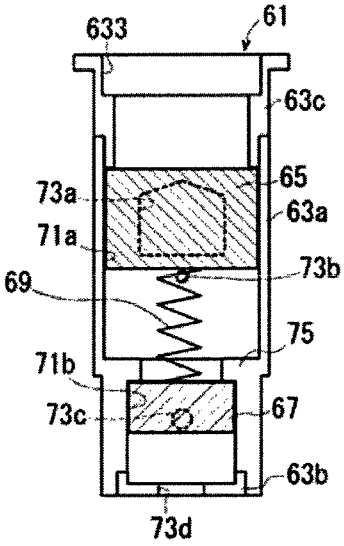

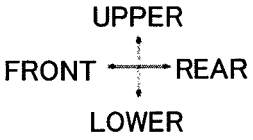
FIG. 9A
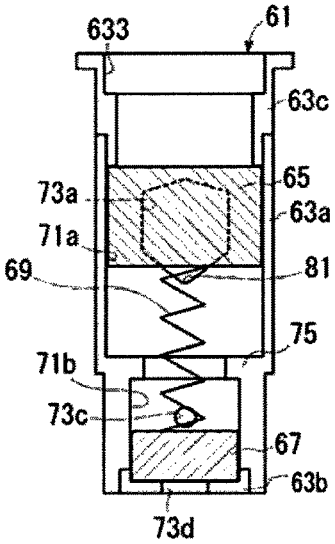
FIG. 9B
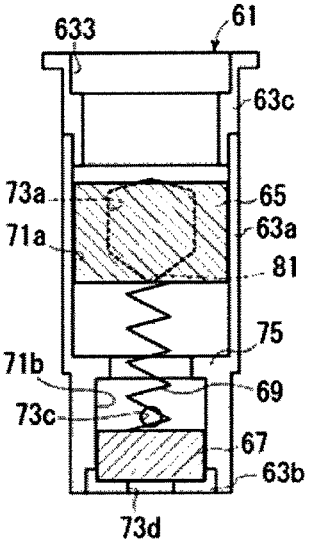
FIG. 9C
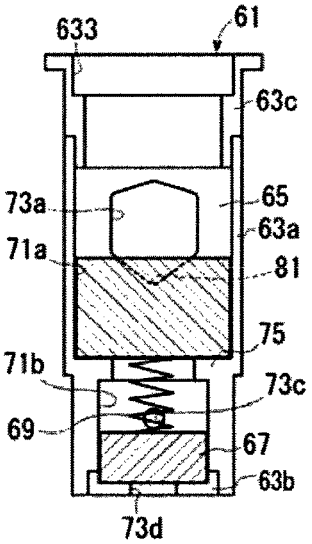
FIG. 9D
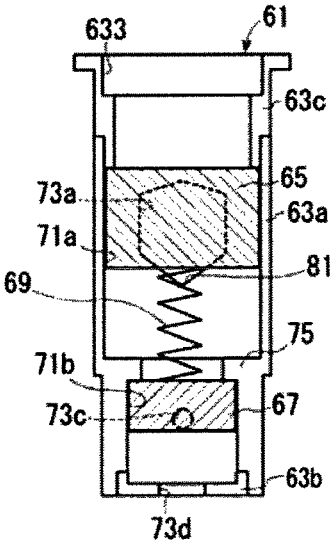

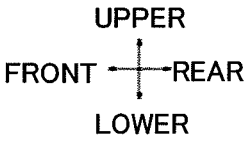
FIG. 10A
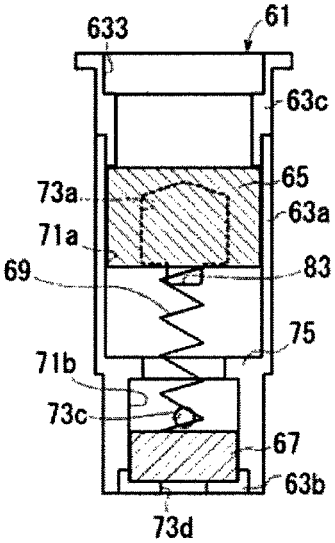
FIG. 10B
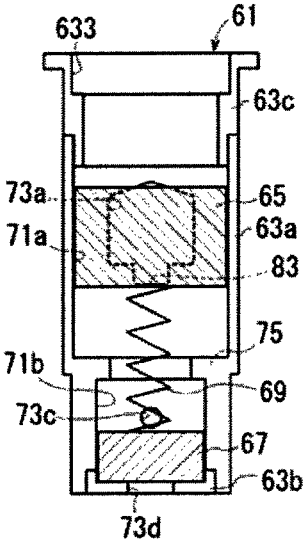
FIG. 10C
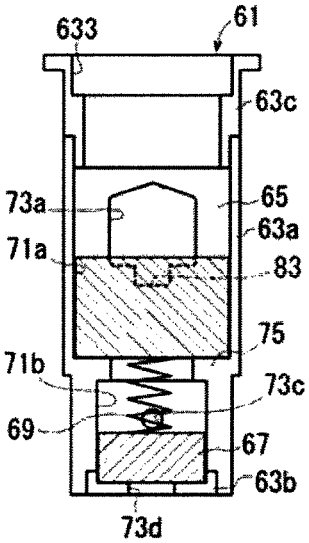
FIG. 10D
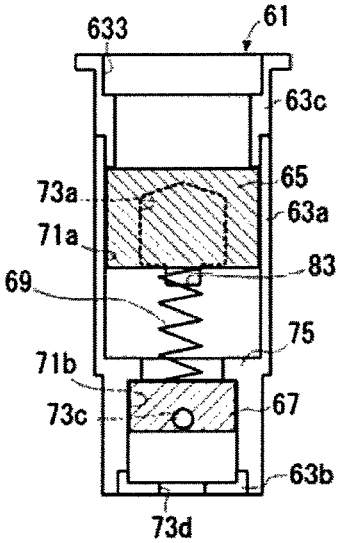

VARIABLE DISPLACEMENT SWASH PLATE TYPE COMPRESSOR

BACKGROUND ART

The present disclosure relates to a variable displacement swash plate type compressor.

Japanese Unexamined Patent Application Publication No. 2006-207464 discloses a well-known variable displacement swash plate type compressor, which is simply referred to as a compressor herein. This compressor includes a housing, a swash plate, a plurality of pistons, a displacement control valve, and an open degree adjustment valve. The housing has a suction chamber, a plurality of cylinder bores, a crank chamber, and a discharge chamber. The swash plate is disposed within the crank chamber, and an inclination angle of the swash plate is altered depending on a crank chamber pressure. Each piston is disposed in the corresponding cylinder bore and cooperates with the housing to form a compression chamber. The piston is configured to reciprocate in the cylinder bore at a stroke depending on the inclination angle of the swash plate. The piston operates to draw refrigerant from the suction chamber to the compression chamber to compress it, and operates to flow the compressed refrigerant from the compression chamber to the discharge chamber. The displacement control valve is configured to change a crank chamber pressure. The open degree adjustment valve is configured to at least adjust the rate of refrigerant that is introduced into the suction chamber.

Specifically, the housing has a suction passage, a first supply passage, a second supply passage, a bleed passage, a suction communication passage, a bleed communication passage, and a control communication passage. The suction passage connects the suction chamber to a refrigerant circuit outside the compressor. The first supply passage connects the discharge chamber to the displacement control valve. The second supply passage connects the displacement control valve to the crank chamber. The bleed passage connects the crank chamber to the suction chamber. The suction communication passage connects the suction chamber to the open degree adjustment valve. The bleed communication passage connects the crank chamber to the open degree adjustment valve. The control communication passage connects the second supply passage to the open degree adjustment valve. The displacement control valve is configured to adjust a communication area between the first supply passage and the second supply passage for controlling the refrigerant rate flowing to the crank chamber, thereby changing the crank chamber pressure.

The open degree adjustment valve includes a first valve chamber, a second valve chamber, a first valve body, a second valve body, and an urging spring. The first valve chamber has a suction port that opens to the refrigerant circuit outside the compressor and extends in the housing in a radial direction of the housing. The first valve chamber opens to the suction communication passage in an axial direction of the housing. The second valve chamber communicates with the first valve chamber and extends in the housing in the radial direction of the housing. The second valve chamber opens to the bleed communication passage in the axial direction of the housing and to the control communication passage in the radial direction of the housing. The first valve body is accommodated in the first valve chamber. The second valve body is accommodated in the second valve chamber. The first body moves in the first valve chamber in the radial direction of the housing depending on a difference between the crank chamber pressure and a suction pressure of refrigerant to be introduced into the suction chamber. The second valve body also moves in the second valve chamber in the radial direction of the housing depending on the difference between the crank chamber pressure and the suction pressure. The first and the second valve body are connected to each other through the urging spring.

In this compressor, the first valve body and the second valve body decrease an open degree of the suction passage and an open degree of the bleed passage, respectively, as the difference between the suction pressure and the crank chamber pressure increases. In contrast, the first valve body and the second valve body increase the open degree of the suction passage and the open degree of the bleed passage, respectively, as the difference between the suction pressure and the crank chamber pressure decreases. This eliminates or minimizes a drop of the suction pressure while a displacement of the compressor is maximal or relatively large.

However, in the above-described compressor, volumetric efficiency is not sufficient while the displacement of the compressor is minimal or relatively small. Also, during a startup of this compressor, it is difficult to promptly flow refrigerant such as a liquid refrigerant, which may be filled in the crank chamber, from the crank chamber to the suction chamber in the compressor, thus, it is difficult to quickly increase the displacement of the compressor.

Specifically, in this compressor, the second valve body of the open degree adjustment valve does not close the bleed passage. During the minimum or relatively small displacement, the compressor allows the compressed refrigerant to flow from the crank chamber to the suction chamber and performs recompression of the refrigerant. Therefore, the volumetric efficiency of the compressor is not sufficient during the minimum or relatively small displacement. If the communication area of the bleed passage is set relatively small, it is difficult to promptly flow refrigerant from the crank chamber to the suction chamber during the startup of the compressor, and thus, it is difficult to quickly increase the displacement of the compressor during the startup of the compressor.

One way to solve this problem may be to use a bleed valve that is capable of adjusting the communication area of the bleed passage, for example, a bleed valve that is mentioned in Japanese Unexamined Patent Application Publication No. 2011-185138, while setting the communication area of the bleed passage relatively large. If this bleed valve is set to open the bleed passage largely during the startup of the compressor, the compressor flows refrigerant such as the liquid refrigerant to the suction chamber promptly, and therefore, it may be easy for the compressor to quickly increase its displacement during the startup of the compressor. Also, if this bleed valve is set to close the bleed passage during the minimum or relatively small displacement of the compressor, the compressor does not recompress the compressed refrigerant in the crank chamber, thereby possibly increasing the volumetric efficiency.

However, using this kind of bleed valve increases a number of parts of the compressor, thereby increasing manufacturing cost and decreasing freedom of design of the compressor.

Further, in the compressor mentioned in the publication No. 2006-207464, refrigerant flows from the crank chamber to the suction chamber through a clearance formed between an inner peripheral surface of the first valve chamber and an outer peripheral surface of the first valve body. This increases a flow rate of refrigerant that flows out of the first valve chamber, which makes it difficult for the compressor to maintain the pressure in the first valve chamber and the pressure in the second valve chamber suitably. In this state, the first valve body may move unnecessarily, so that flow rate of refrigerant that flows from the refrigerant circuit outside the compressor to the suction chamber is likely to be unstable and suction pulsation may become large. Accordingly, in this compressor, quietness may be low during the minimum or relatively small displacement.

The present disclosure, which has been made in light of the above described problem, is directed to providing a variable displacement swash plate type compressor that:

(1) ensures quietness during the minimum or relatively small displacement while eliminating or minimizing a drop of the suction pressure during the maximal or relatively large displacement of the compressor;

(2) provides high volumetric efficiency during the minimum or relatively small displacement without increasing manufacturing cost and decreasing the freedom of design of the compressor; and (3) promptly flows refrigerant such as a liquid refrigerant, which may be filled in a crank chamber of the compressor, from the crank chamber to the suction chamber to quickly increase the displacement during the startup of the compressor.

SUMMARY

In accordance with one aspect of the present disclosure, there is provided a variable displacement swash plate type compressor including a housing, a swash plate, a piston, a displacement control valve, and an open degree adjustment valve. The housing has a suction chamber, a cylinder bore, a crank chamber, and a discharge chamber. The swash plate is disposed in the crank chamber. An inclination angle of the swash plate is changed depending on a crank chamber pressure in the crank chamber. The piston is disposed in the cylinder bore and cooperates with the housing to form therebetween a compression chamber. The piston is configured to reciprocate in the cylinder bore at a stroke depending on the inclination angle of the swash plate to draw refrigerant from the suction chamber into the compression chamber to compress the refrigerant in the compression chamber. The piston is configured to discharge the compressed refrigerant from the compression chamber to the discharge chamber. The displacement control valve is disposed in the housing and is configured to adjust the crank chamber pressure. The open degree adjustment valve is disposed in the housing and configured to at least adjust a rate of refrigerant that is introduced into the suction chamber. The housing further has a suction passage configured to connect the suction chamber to a refrigerant circuit outside the variable displacement swash plate type compressor, a first supply passage configured to connect the discharge chamber to the displacement control valve, a second supply passage configured to connect the displacement control valve to the crank chamber, a bleed passage configured to connect the crank chamber to the suction chamber, a suction communication passage configured to connect the suction chamber to the open degree adjustment valve, a bleed communication passage configured to connect the crank chamber to the open degree adjustment valve, and a control communication passage configured to connect the second supply passage to the open degree adjustment valve. The open degree adjustment valve includes a valve case, a first valve body, a second valve body, and an urging spring. The valve case has a suction port, a first valve chamber, a second valve chamber, a suction window, a bleed window, and a communication window. The suction port opens to the refrigerant circuit. The first valve chamber has a cylindrical shape and extends in a first direction. The second valve chamber has a cylindrical shape and formed coaxially with the first valve chamber. The second valve chamber is configured to communicate with the first valve chamber. The first valve chamber is connected to the suction communication passage through the suction window in a second direction crossing the first direction. The second valve chamber is connected to the bleed communication passage through the bleed window in the second direction. The second valve chamber is connected to the control communication passage through the communication window in the first direction. The first valve body is accommodated in the first valve chamber and is movable in the first valve chamber in the first direction to adjust an open degree of the suction window. The second valve body is accommodated in the second valve chamber and is movable in the second valve chamber in the first direction to adjust an open degree of the bleed window. The urging spring is disposed between the first valve body and the second valve body, and connects the first valve body to the second valve body. The open degree of the suction window is minimized by the first valve body and the open degree of the bleed window is maximized by the second valve body when a suction pressure of refrigerant introduced to the suction chamber is lower than a predetermined suction pressure and the crank chamber pressure is higher than a control pressure in the second supply passage. The open degree of the suction window is increased by a movement of the first valve body and the open degree of the bleed window is maximized by the second valve body when the suction pressure is higher than the predetermined suction pressure and the crank chamber pressure is higher than the control pressure. The open degree of the suction window is decreased by the movement of the first valve body and the open degree of the bleed window is decreased by a movement of the second valve body when the crank chamber pressure is lower than the control pressure. At least one of the valve case and the first valve body has an open passage that is configured to connect the first valve chamber to the suction communication passage. An open degree of the open passage is maximal when the suction pressure is lower than the predetermined suction pressure and the crank chamber pressure is higher than the control pressure. The open degree of the open passage is minimal when the open degree of the suction window is made greater than a minimum open degree of the suction window by the first valve body.

Other aspects and advantages of the present disclosure will become apparent from the following description, taken in conjunction with the accompanying drawings, illustrating by way of example the principles of the present disclosure.

BRIEF DESCRIPTION OF THE DRAWINGS

The present disclosure together with objects and advantages thereof, may best be understood by reference to the following description of the presently preferred embodiments together with the accompanying drawings in which:

FIG. 5A is a schematic view of an open degree adjustment valve of the compressor of FIG. 1 during the startup of the compressor;

FIG. 5B is a schematic view of the open degree adjustment valve of the compressor of FIG. 1 when a first valve body starts to open suction windows;

FIG. 5C is a schematic view of the open degree adjustment valve of the compressor of FIG. 1 during the maximum displacement of the compressor;

FIG. 5D is a schematic view of the open degree adjustment valve of the compressor of FIG. 1 during the minimum displacement of the compressor;

FIG. 9A is a schematic view of the open degree adjustment valve of the compressor according to the second embodiment during the startup of the compressor;

FIG. 9B is a schematic view of the open degree adjustment valve of the compressor according to the second embodiment when the first valve body starts to open the suction windows;

FIG. 9C is a schematic view of the open degree adjustment valve of the compressor according to the second embodiment during the maximum displacement of the compressor;

FIG. 9D is a schematic view of the open degree adjustment valve of the compressor according to the second embodiment during the minimum displacement of the compressor;

FIG. 10A is a schematic view of the open degree adjustment valve of the compressor according to a third embodiment during the startup of the compressor;

FIG. 10B is a schematic view of the open degree adjustment valve of the compressor according to the third embodiment when the first valve body starts to open the suction windows;

FIG. 10C is a schematic view of the open degree adjustment valve of the compressor according to the third embodiment during the maximum displacement of the compressor;

FIG. 10D is a schematic view of the open degree adjustment valve of the compressor according to the third embodiment during the minimum displacement of the compressor;

DETAILED DESCRIPTION OF THE EMBODIMENTS

The following will describe four embodiments of the present disclosure with reference to the accompanying drawings.

First Embodiment

Figure 1:
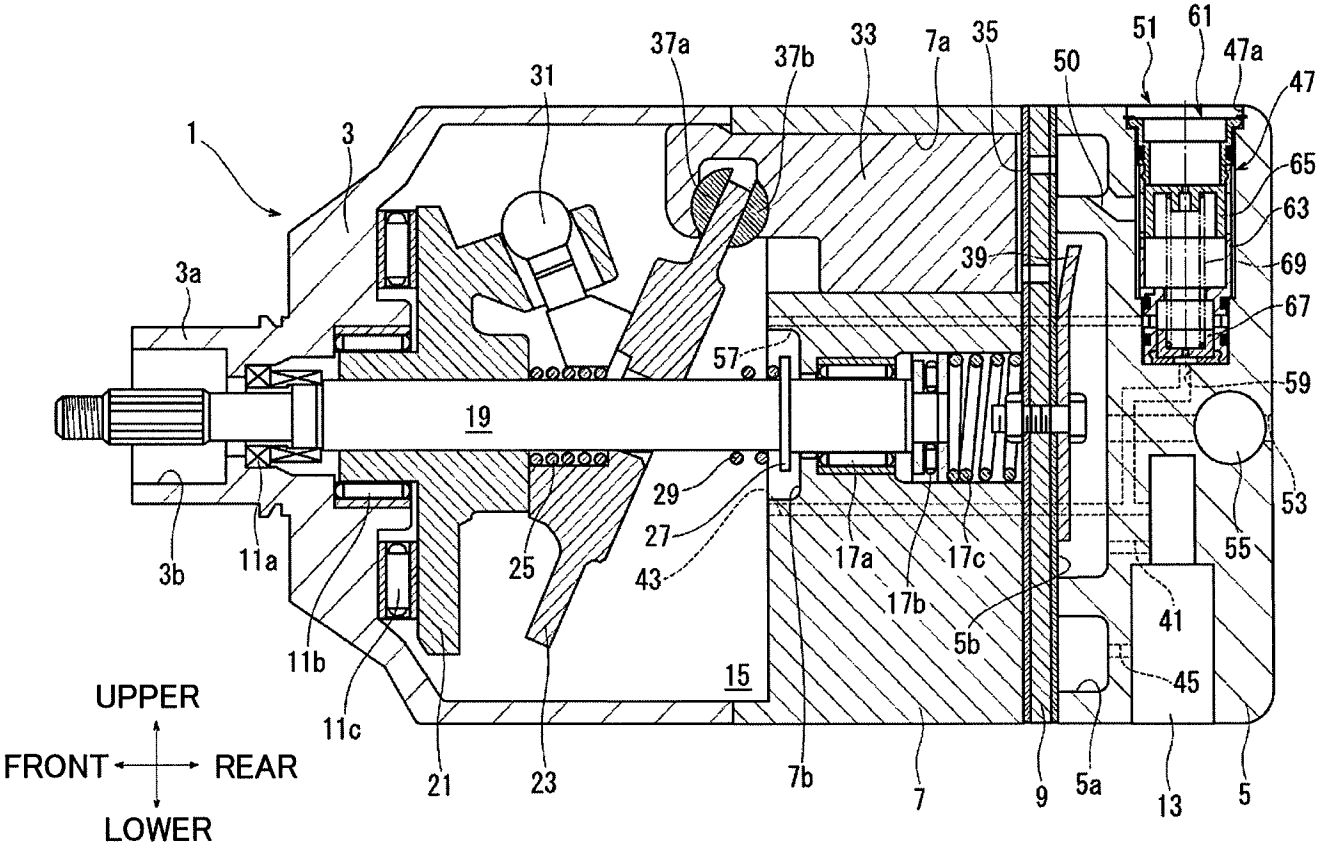
FIG. 1 is a sectional view of a compressor according to a first embodiment of the present disclosure.

A compressor according to a first embodiment is, as shown in FIG. 1, a variable displacement swash plate type compressor having a single headed piston. This compressor is mounted to a vehicle and forms a part of a refrigerant circuit of an air conditioner of the vehicle.

The compressor includes a housing 1, a drive shaft 19, a swash plate 23, a plurality of pistons 33, a displacement control valve 13, and an open degree adjustment valve 61. The housing 1 includes a front housing member 3, a rear housing member 5, a cylinder block 7, and a valve forming plate unit 9. In this embodiment, a longitudinal direction of the compressor is defined with respect to a position of the front housing member 3 that is located on the left part of FIG. 1 and a position of the rear housing member 5 on the right part of FIG. 1. That is, a side of the compressor on which the front housing member 3 is located is a front side of the compressor, and the other side on which the rear housing member 5 is located is a rear side of the compressor. The vertical direction of FIG. 1 will be referred to as a vertical direction of the compressor, that is, the upper side and the lower side of FIG. 1 will be referred to as an upper side and a lower side of the compressor, respectively. Directions indicated in FIGS. 2 to 14 correspond to the directions indicated in FIG. 1. The compressor of the present disclosure may be mounted appropriately in various postures depending on the vehicle on which the compressor is mounted.

As shown in FIG. 1, the front housing member 3 has a boss 3*a* that extends forward and has a first shaft hole 3*b*. The first shaft hole 3*b* extends in the boss 3*a* in the longitudinal direction of the compressor and has therein a sealing device 11*a* and a first radial bearing 11*b*. The front housing member 3 has a first thrust bearing 11*c* at a rear surface of the front housing member 3.

The rear housing member 5 has a suction chamber 5*a* and a discharge chamber 5*b*. The displacement control valve 13 is disposed in the rear housing member 5. The discharge chamber 5*b* is disposed approximately in a radially central portion of the rear housing member 5. The suction chamber 5*a* is disposed radially outward of the discharge chamber 5*b* in the rear housing member 5. The suction chamber 5*a* is connected to an evaporator (i.e., the refrigerant circuit) outside the compressor by a suction passage 51 that will be described later. The discharge chamber 5*b* is connected to a condenser outside the compressor by a discharge passage 53. A check valve 55 is disposed in the discharge passage 53. The air conditioner is formed of the compressor, the condenser, an expansion valve, the evaporator, and the like. The components of the air conditioner such as the condenser, the expansion valve, and the evaporator are not illustrated in FIGS. 1 to 14.

The cylinder block 7 is disposed between the front housing member 3 and the valve forming plate unit 9. A crank chamber 15 is defined between the front housing member 3 and the cylinder block 7. The cylinder block 7 has a plurality of cylinder bores 7*a*. In other words, the housing 1 has the cylinder bores 7*a* and the crank chamber 15. The cylinder bores 7*a* are arranged circumferentially and equiangularly. Each of the cylinder bores 7*a* extends in the longitudinal direction of the compressor and communicates with the crank chamber 15 at a front end thereof.

The cylinder block 7 further has a second shaft hole 7*b* that is disposed coaxially with the first shaft hole 3*b*. A second radial bearing 17*a*, a second thrust bearing 17*b*, and a pressing spring 17*c* are disposed in the second shaft hole 7*b*.

The drive shaft 19 extends through the front housing member 3 and the cylinder block 7 in the longitudinal direction of the compressor. Specifically, a front end of the drive shaft 19 passes through the sealing device 11*a* in the front housing member 3, and a rear end of the drive shaft 19 passes through the second radial bearing 17*a* and the second thrust bearing 17*b* in the cylinder block 7. Accordingly, the drive shaft 19 is supported by the housing 1 and is rotatable. An axis of the drive shaft 19 is parallel to the longitudinal direction of the compressor.

A lug plate 21 is press-fitted to the drive shaft 19. The lug plate 21 is disposed in a front part of the crank chamber 15 and is rotatable with the drive shaft 19 in the crank chamber 15. The first radial bearing 11*b* and the first thrust bearing 11*c* are disposed between the lug plate 21 and the front housing member 3.

The drive shaft 19 extends through the swash plate 23 that is disposed in the crank chamber 15 and behind the lug plate 21. A control spring 25 for decreasing an inclination angle of the swash plate 23 is disposed between the lug plate 21 and the swash plate 23. A retaining ring 27 is secured to a rear part of the drive shaft 19. A return spring 29 is disposed between the retaining ring 27 and the swash plate 23. The drive shaft 19 is surrounded in a peripheral direction thereof by the control spring 25 and the return spring 29.

The lug plate 21 and the swash plate 23 are connected to each other by a link mechanism 31 in the crank chamber 15. The swash plate 23 is supported by the link mechanism 31 such that the inclination angle of the swash plate 23 is changeable with respect to a direction perpendicular to the axis of the drive shaft 19 depending on a crank chamber pressure Pc.

Each piston 33 is disposed in the corresponding cylinder bore 7*a* such that the piston 33 is reciprocally movable in the cylinder bore 7*a*. A rear end surface of the piston 33 faces the valve forming plate unit 9 in the cylinder bore 7*a* to define a compression chamber 35 in a rear part of the cylinder bore 7*a*. In other words, the piston 33 cooperates with the housing 1 to form therebetween a compression chamber 35.

A pair of shoes 37*a*, 37*b* is disposed between the piston 33 and the swash plate 23 such that the shoes 37*a*, 37*b* are arranged in the longitudinal direction of the compressor and respectively disposed at opposite sides of the swash plate 23. The shoes 37*a*, 37*b* are configured to convert rotation of the swash plate 23 to reciprocating motion of the piston 33 and to allow the piston 33 to reciprocate in the cylinder bore 7*a* at a stroke depending on the inclination angle of the swash plate 23.

The valve forming plate unit 9 is a stack of a suction valve plate, a valve plate, and a discharge valve plate that are stacked in this order from front to rear in the longitudinal direction of the compressor. The valve forming plate unit 9 includes a suction reed valve, a suction port, a discharge port, and a discharge reed valve that correspond to each cylinder bore 7*a*. A retainer 39 is secured to a rear surface of the valve forming plate unit 9. The retainer 39 is disposed in the discharge chamber 5*b* to determine a maximum open degree of the discharge reed valve.

Figure 2:
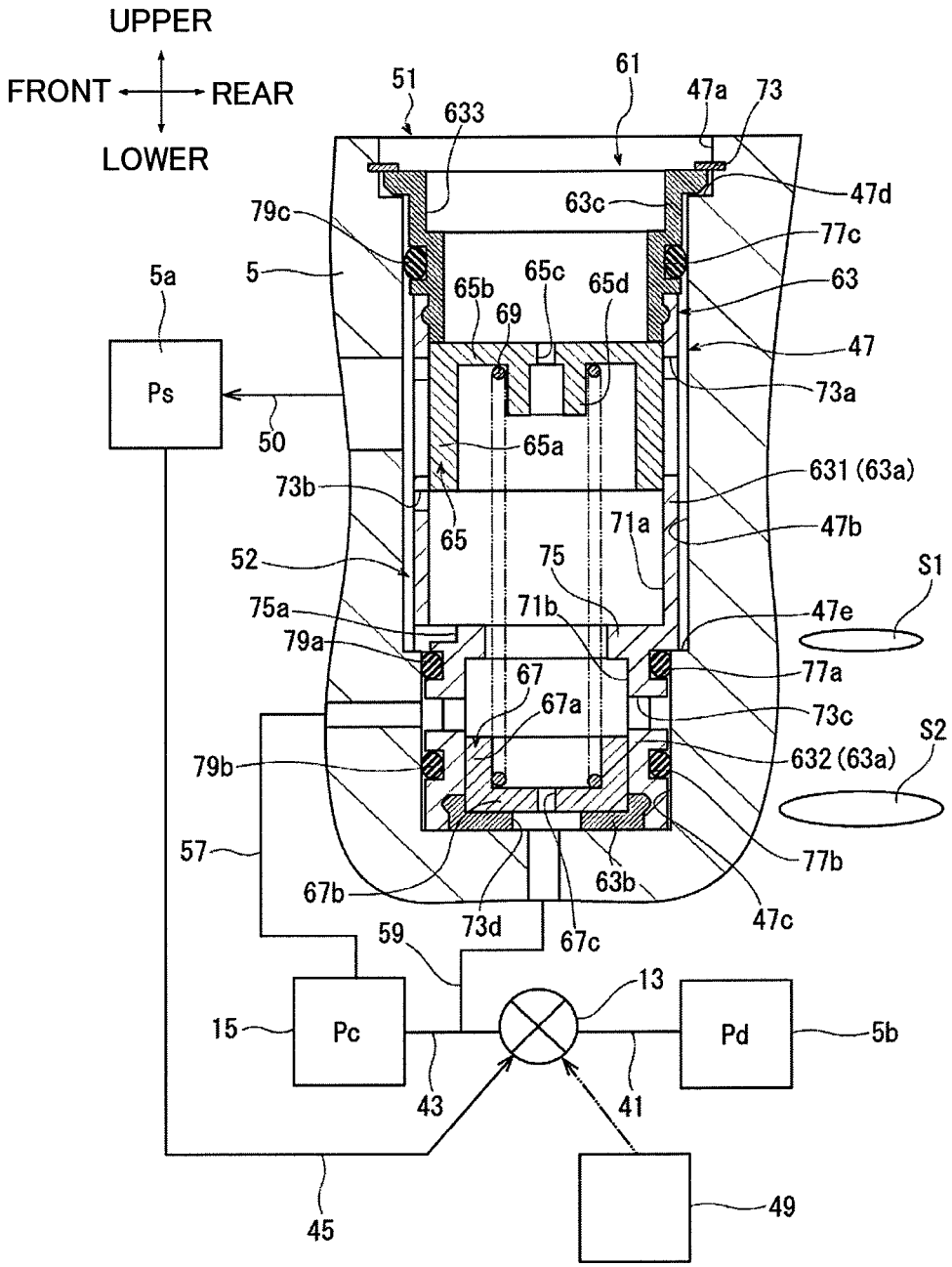
FIG. 2 is an enlarged sectional view of a main part of the compressor of FIG. 1 during the startup of the compressor.

As shown in FIG. 2, the housing 1 of this compressor has a first supply passage 41, a second supply passage 43, a detection passage 45, and a valve accommodation chamber 47. The first supply passage 41 is configured to connect the discharge chamber 5*b* to the displacement control valve 13. The second supply passage 43 is configured to connect the displacement control valve 13 to the crank chamber 15. The detection passage 45 connects the suction chamber 5*a* to the displacement control valve 13. The valve accommodation chamber 47 extends within the rear housing member 5 in a first direction, which, in this embodiment, is the radial direction of the rear housing member 5.

The first supply passage 41, the detection passage 45, and the valve accommodation chamber 47 are formed within the rear housing member 5. The second supply passage 43 extends between the crank chamber 15 and the displacement control valve 13 through the retainer 39, the valve forming plate unit 9, and the cylinder block 7 in the axial direction of the compressor. The displacement control valve 13 is disposed in the rear housing member 5 and configured to adjust a communication area between the first supply passage 41 and the second supply passage 43 depending on a suction pressure Ps in the suction chamber 5*a* and responding to a signal from a controller 49 that is shown in FIG. 2. In other words, the displacement control valve 13 is configured to adjust the crank chamber pressure Pc.

The valve accommodation chamber 47 has an opening 47*a*, a first valve accommodation chamber 47*b*, and a second valve accommodation chamber 47*c*. The opening 47*a* opens to the refrigerant circuit outside the rear housing member 5, in other words, opens to the evaporator. The first valve accommodation chamber 47*b* has a cylindrical shape whose diameter is smaller than a diameter of the opening 47*a*. An upper end of the first valve accommodation chamber 47*b* is connected to the opening 47*a*. The second valve accommodation chamber 47*c* has a cylindrical shape whose diameter is smaller than the diameter of the first valve accommodation chamber 47*b*. An upper end of the second valve accommodation chamber 47*c* is connected to a lower end of the first valve accommodation chamber 47*b*. In the valve accommodation chamber 47, a step portion 47*d* is formed between the opening 47*a* and the first valve accommodation chamber 47*b*, and a step portion 47*e* is formed between the first valve accommodation chamber 47*b* and the second valve accommodation chamber 47*c*. The open degree adjustment valve 61 is disposed in the valve accommodation chamber 47 (i.e., the housing 1).

Figure 3:
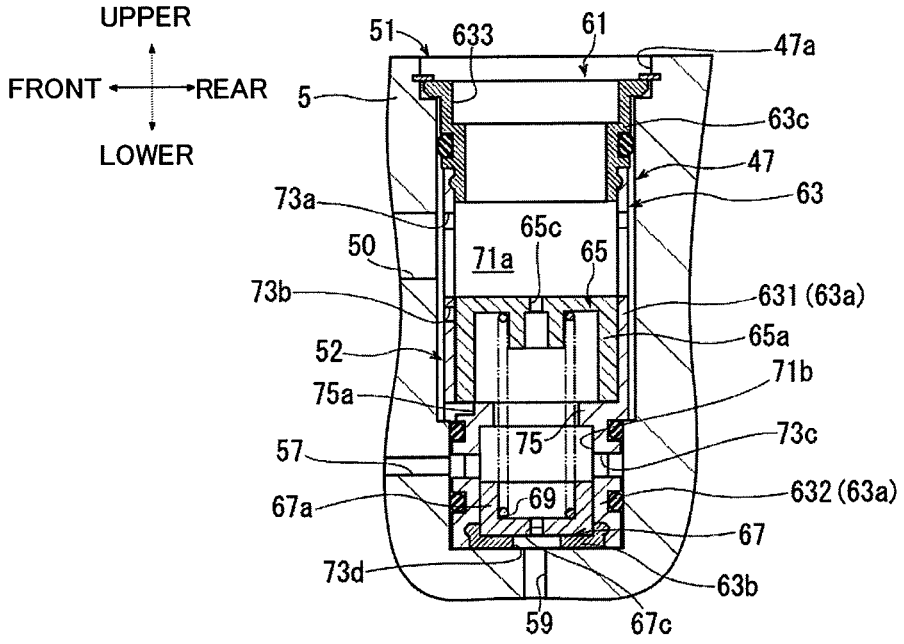
FIG. 3 is an enlarged sectional view of the main part of the compressor of FIG. 1 while a displacement of the compressor is maximal.
Figure 4:
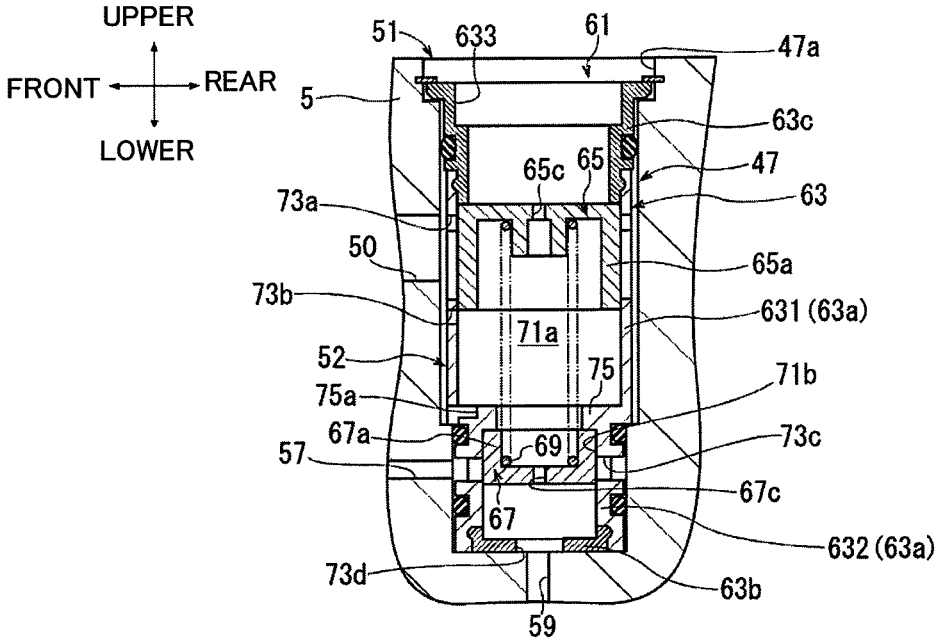
FIG. 4 is an enlarged sectional view of the main part of the compressor of FIG. 1 while the displacement of the compressor is minimal.

As shown in FIGS. 2 to 4, the open degree adjustment valve 61 includes a valve case 63, a first valve body 65, a second valve body 67, and an urging spring 69, and is configured to at least adjust the rate of refrigerant that is introduced into the suction chamber 5*a*. The valve case 63 includes a cylindrical portion 63*a*, a covering portion 63*b*, and a supporting portion 63*c*. The cylindrical portion 63*a* includes a large diameter portion 631 and a small diameter portion 632. The large diameter portion 631 has a cylindrical shape whose diameter is slightly smaller than the diameter of the first valve accommodation chamber 47*b*. The small diameter portion 632 is formed integrally and coaxially with the large diameter portion 631, and has a cylindrical shape whose diameter is slightly smaller than the diameter of the second valve accommodation chamber 47*c*. The large diameter portion 631 and the small diameter portion 632 (i.e., the valve case 63) have therein a first valve chamber 71*a* and a second valve chamber 71*b*, respectively. The first valve chamber 71*a* has a cylindrical shape and extends in the radial direction of the rear housing member 5. The second valve chamber 71*b* is formed coaxially with the first valve chamber 71*a* and has a cylindrical shape whose diameter is smaller than the diameter of the first valve chamber 71*a*. The second valve chamber 71*b* is configured to communicate with the first valve chamber 71*a* and extends in the radial direction of the rear housing member 5. The first valve body 65 and the second valve body 67 are respectively accommodated in the first valve chamber 71*a* and the second valve chamber 71*b*.

The open degree adjustment valve 61 is inserted into the valve accommodation chamber 47 and retained by a retaining ring 73. An upper portion of the supporting portion 63*c* and a lower portion of the large diameter portion 631 are disposed in contact with the step portion 47*d* and the step portion 47*e*, respectively.

The large diameter portion 631 of the cylindrical portion 63*a* has a plurality of suction windows 73*a*. The suction windows 73*a* are arranged in a circumferential direction of the large diameter portion 631. Each suction window 73*a* has an approximately rectangular shape whose opening area decreases toward the supporting portion 63*c* as shown in FIGS. 5A to 5D. As shown in FIGS. 2 to 4, the first valve chamber 71*a* is connected to the first valve accommodation chamber 47*b* and therefore to a suction communication passage 50 through the suction window 73*a* in a second direction, which, in this embodiment, is a direction crossing the radial direction of the rear housing member 5. The suction communication passage 50 will be described later.

The large diameter portion 631 of the valve case 63 has a single open passage 73*b* that is defined between each of the suction windows 73*a* and the second valve chamber 71*b* as shown in FIGS. 5A to 5D. That is, the suction window 73*a* and the open passage 73*b* are formed separately from each other in the large diameter portion 631. As shown in FIGS. 5A to 5D, the open passage 73*b* has a circular shape in section and is smaller than the suction window 73*a*. As shown in FIGS. 2 to 4, the first valve chamber 71*a* is connected to the suction communication passage 50 through the open passage 73*b* in the direction crossing the radial direction of the rear housing member 5. Accordingly, the open passage 73*b* is configured to connect the first valve chamber 71*a* to the suction communication passage 50 through the first valve accommodation chamber 47*b*. The number of the suction windows 73*a* and the diameter of the open passage 73*b* may be determined as necessary.

The small diameter portion 632 of the cylindrical portion 63*a* has a plurality of bleed windows 73*c*. The bleed windows 73*c* are arranged in the small diameter portion 632 in a circumferential direction of the small diameter portion 632. As shown in FIGS. 5A to 5D, each bleed window 73*c* has a circular shape in section and is smaller than the suction window 73*a*. As shown in FIGS. 2 to 4, the second valve chamber 71*b* is connected to the second valve accommodation chamber 47*c* and therefore to a bleed communication passage 57 through the bleed window 73*c* in the direction crossing the radial direction of the rear housing member 5. The number of the bleed windows 73*c* and the diameter of each bleed window 73*c* may also be determined as necessary. The bleed communication passage 57 will be described later.

The cylindrical portion 63*a* has a projecting portion 75 disposed between the large diameter portion 631 and the small diameter portion 632. The projecting portion 75 projects from an inner peripheral surface of the cylindrical portion 63*a* and extends in a circumferential direction of the cylindrical portion 63*a* to form an annular shape. The projecting portion 75 determines a lower movement limit of the first valve body 65 and an upper movement limit of the second valve body 67. When the second valve body 67 is in contact with the projecting portion 75, as shown in FIG. 2, a first pressure receiving area S1 is secured on an upper surface of the second valve body 67 by an inner diameter of the projecting portion 75. A second pressure receiving area S2 is also secured on a bottom surface of the second valve body 67. The second pressure receiving area S2 is greater than the first pressure receiving area S1.

The projecting portion 75 has a plurality of valve communication holes 75*a*. The valve communication holes 75*a* are arranged in a circumferential direction of the projecting portion 75. The first valve accommodation chamber 47*b* is connected to the first valve chamber 71*a* through the valve communication holes 75*a*. The valve communication holes 75*a* are not closed by the first valve body 65 when the first valve body 65 is located at the lower movement limit. The small diameter portion 632 has O-ring grooves 77*a*, 77*b*. The O-ring grooves 77*a*, 77*b* are formed in the outer peripheral surface of the small diameter portion 632. The O-ring groove 77*a* and the O-ring groove 77*b* extend above and below each of the bleed windows 73*c* in the circumferential direction of the small diameter portion 632 to receive an O-ring 79*a* and an O-ring 79*b*, respectively. The O-rings 79*a*, 79*b* are disposed in contact with an inner peripheral surface of the second valve accommodation chamber 47*c*.

The covering portion 63*b* is secured to an end of the small diameter portion 632 opposite the large diameter portion 631. The covering portion 63*b* has a communication window 73*d* through which the second valve chamber 71*b* is connected to a control communication passage 59 in the radial direction of the rear housing member 5. The control communication passage 59 will be described later. The covering portion 63*b* determines a lower movement limit of the second valve body 67. The shape of the communication window 73*d* may also be determined as necessary.

The supporting portion 63*c* is secured to an end of the large diameter portion 631 opposite the small diameter portion 632. The supporting portion 63*c* determines an upper movement limit of the first valve body 65. The supporting portion 63*c* has an O-ring groove 77*c* that is formed in an outer peripheral surface of the supporting portion 63*c* to receive an O-ring 79*c*. The O-ring 79*c* is disposed in contact with an inner peripheral surface of the first valve accommodation chamber 47*b*.

The supporting portion 63*c* of the valve case 63 has therethrough a suction port 633. The suction port 633 extends through the supporting portion 63*c* in the radial direction of the rear housing member 5. In a state that the open degree adjustment valve 61 is installed in the valve accommodation chamber 47, the suction port 633 opens to the refrigerant circuit outside the compressor through the opening 47*a* of the valve accommodation chamber 47 at an upper end of the suction port 633 and opens to the first valve chamber 71*a* at a lower end of the suction port 633. Accordingly, the suction port 633 forms a part of the first valve chamber 71*a*, and allows the first valve chamber 71*a* to be connected to the evaporator through the suction port 633.

The first valve body 65 includes a cylindrical portion 65*a* having a cylindrical shape and a lid portion 65*b* having a disc shape and formed integrally with a top part of the cylindrical portion 65*a*. The lid portion 65*b* has a vent hole 65*c* and a spring washer 65*d*. The vent hole 65*c* allows the suction port 633 to be connected to the first valve chamber 71*a*. The first valve body 65 is movable in the first valve chamber 71*a* in the radial direction of the rear housing member 5.

The second valve body 67 includes a cylindrical portion 67*a* having a cylindrical shape and a lid portion 67*b* having a disc shape and formed integrally with a bottom part of the cylindrical portion 67*a*. The second valve body 67 is movable in the second valve chamber 71*b* in the radial direction of the rear housing member 5. The lid portion 67*b* of the second valve body 67 has a small hole 67*c*. The small hole 67*c* connects the communication window 73*d* to the second valve chamber 71*b*. The shape of the small hole 67*c* may be determined as necessary.

The urging spring 69 is disposed between the lid portion 65*b* of the first valve body 65 and the lid portion 67*b* of the second valve body 67, and connects the first valve body 65 to the second valve body 67. The urging spring 69 operates to separate the first valve body 65 from the second valve body 67 by an urging force of the urging spring 69.

As shown in FIGS. 5A to 5D, in the open degree adjustment valve 61, the first valve body 65 moves in the first valve chamber 71*a* in the radial direction of the rear housing member 5 to adjust an open degree of each suction window 73*a* and an open degree of the open passage 73*b*. Specifically, as shown in FIG. 5A, when the first valve body 65 is located at the upper movement limit in the first valve chamber 71*a* and is held in contact with the supporting portion 63*c*, the cylindrical portion 65*a* of the first valve body 65 closes the suction window 73*a*, that is, the open degree of the suction window 73*a* is minimized by the first valve body 65. In this state, the open passage 73*b* is fully opened by the cylindrical portion 65*a* of the first valve body 65, that is, the open degree of the open passage 73*b* is maximized by the first valve body 65. Then, as the first valve body 65 moves toward the projecting portion 75 in the first valve chamber 71*a*, the cylindrical portion 65*a* gradually closes the open passage 73*b*, thereby gradually decreasing the open degree of the open passage 73*b* without opening the suction window 73*a*. As the first valve body 65 further moves toward the projecting portion 75 in the first valve chamber 71*a*, as shown in FIG. 5B, the first valve body 65 starts to open the suction window 73*a*, thereby gradually increasing the open degree of the suction window 73*a* from the minimum open degree of the suction windows 73*a*. In other words, the open degree of the suction window 73*a* is increased by a movement of the first valve body 65, that is, the open degree of the suction window 73*a* is made greater than its minimum open degree by the first valve body 65. In this state, the open passage 73*b* is closed by the cylindrical portion 65*a* of the first valve body 65, that is, the open degree of the open passage 73*b* is minimized by the first valve body 65.

As shown in FIG. 5C, when the first valve body 65 is located at the lower movement limit in the first valve chamber 71*a* and is held in contact with the projecting portion 75, the suction window 73*a* is fully opened by the cylindrical portion 65*a* of the first valve body 65, that is, the open degree of the suction window 73*a* is maximized by the first valve body 65. In other words, the open degree of the suction window 73*a* is increased by the movement of the first valve body 65 while the suction pressure Ps is higher than the predetermined suction pressure and the crank chamber pressure Pc is higher than the control pressure Pcv. In this state, the open passage 73*b* is still closed by the cylindrical portion 65*a* of the first valve body 65, thus, the open degree of the open passage 73*b* is minimized.

As described above, a positional relationship between the suction window 73*a* and the open passage 73*b* is designed relative to the movement of the first valve body 65. Specifically, the open degree of the open passage 73*b* is maximal when the open degree of the suction window 73*a* is minimized by the first valve body 65. The open degree of the open passage 73*b* is minimal when the open degree of the suction window 73*a* is made greater than its minimum open degree by the first valve body 65.

In the open degree adjustment valve 61, the second valve body 67 moves in the second valve chamber 71*b* in the radial direction of the rear housing member 5 to adjust an open degree of each bleed window 73*c*. Specifically, as shown in FIGS. 5A to 5C, when the second valve body 67 is located at the lower movement limit in the second valve chamber 71*b* and is held in contact with the covering portion 63*b*, the bleed window 73*c* is opened by the cylindrical portion 67*a* of the second valve body 67, that is, the open degree of the bleed window 73*c* is maximized by the second valve body 67. Then, as the second valve body 67 moves toward the projecting portion 75 in the second valve chamber 71*b*, the cylindrical portion 67*a* of the second valve body 67 gradually closes the bleed window 73*c*, thereby gradually decreasing the open degree of the bleed window 73*c*. As shown in FIG. 5D, when the second valve body 67 is located at the upper movement limit in the second valve chamber 71*b* and is held in contact with the projecting portion 75, the bleed window 73*c* is closed by the cylindrical portion 67*a*, that is, the open degree of the bleed window 73*c* is minimized by the second valve body 67. As the second valve body 67 moves toward the projecting portion 75 in the second valve chamber 71*b*, a load of the urging spring 69 that is applied to the first valve body 65 increases. Accordingly, the load moves the first valve body 65 toward the supporting portion 63*c* in the first valve chamber 71*a*. When the second valve body 67 is located at the upper movement limit in the second valve chamber 71*b*, the first valve body 65 is located at the upper movement limit in the first valve chamber 71*a*, thus, the open degree of each suction window 73*a* is minimized by the first valve body 65. In FIGS. 5A to 5D, 9A to 9D, and 10A to 10D, for the sake of description, the shapes of the first and the second valve body 65, 67 are simplified, and the valve communication hole 75*a* and the small hole 67*c* are not illustrated.

As shown in FIG. 2, the rear housing member 5 has the suction communication passage 50, the bleed communication passage 57, and the control communication passage 59. The suction communication passage 50 is connected to the suction chamber 5*a* and the first valve accommodation chamber 47*b* at the opposite ends of the suction communication passage 50. That is, the suction communication passage 50 is configured to connect the suction chamber 5*a* to the first valve chamber 71*a* of the open degree adjustment valve 61 through the first valve accommodation chamber 47*b* and the suction window 73*a*. In this compressor, the housing 1 has the suction passage 51 that is formed of the opening 47*a* of the valve accommodation chamber 47, the suction port 633 of the supporting portion 63*c*, the first valve chamber 71*a*, the suction window 73*a*, the first valve accommodation chamber 47*b*, and the suction communication passage 50. This configuration allows an upper surface of the first valve body 65 to receive the suction pressure Ps to be introduced into the compressor. The first valve body 65 moves and adjusts the open degree of the suction window 73*a* by receiving the suction pressure Ps, thereby adjusting a communication area between the suction communication passage 50 and the first valve chamber 71*a*. The first valve body 65 also adjusts the open degree of the open passage 73*b*, thereby adjusting the communication area between the suction communication passage 50 and the first valve chamber 71*a*.

The bleed communication passage 57 is connected to the crank chamber 15 and the second valve accommodation chamber 47*c* at opposite ends of the bleed communication passage 57. That is, the bleed communication passage 57 is configured to connect the crank chamber 15 to the second valve chamber 71*b* of the open degree adjustment valve 61 through the second valve accommodation chamber 47*c* and the bleed window 73*c*. In this compressor the housing 1 has a bleed passage 52 that is formed of the bleed communication passage 57, the second valve accommodation chamber 47*c*, the bleed window 73*c*, the second valve chamber 71*b*, the first valve chamber 71*a*, the valve communication hole 75*a*, the first valve accommodation chamber 47*b*, and the suction communication passage 50. The bleed passage 52 is configured to connect the crank chamber 15 to the suction chamber 5*a*. The second valve body 67 adjusts the open degree of the bleed window 73*c*, thereby adjusting a communication area between the bleed communication passage 57 and the second valve chamber 71*b*.

The control communication passage 59 is connected to the second supply passage 43 and the second valve accommodation chamber 47*c* at opposite ends of the control communication passage 59. That is, the control communication passage 59 is configured to connect the second supply passage 43 to the second valve chamber 71*b* of the open degree adjustment valve 61 through the second valve accommodation chamber 47*c* and the communication window 73*d*. This configuration allows the bottom surface of the second valve body 67 to receive a control pressure Pcv in the second supply passage 43.

In this compressor, the drive shaft 19 is rotary driven by an engine or a motor of the vehicle to rotate the lug plate 21 and the swash plate 23, thereby reciprocating each piston 33 in the corresponding cylinder bore 7*a* at a stroke depending on the inclination angle of the swash plate 23. The piston 33 draws refrigerant from the suction chamber 5*a* into the compression chamber 35 to compress it, and discharges the compressed refrigerant from the compression chamber 35 to the discharge chamber 5*b*.

During this operation, in this compressor, the displacement control valve 13 adjusts a crank chamber pressure Pc in the crank chamber 15 as necessary to vary a displacement of the compressor. For example, the crank chamber pressure Pc increases as the displacement control valve 13 increases the communication area between the first supply passage 41 and the second supply passage 43 to promote the refrigerant flow at discharge pressure Pd from the discharge chamber 5*b* to the crank chamber 15. This decreases the inclination angle of the swash plate 23, thereby decreasing a displacement of the compressor per rotation of the drive shaft 19. In contrast, as the displacement control valve 13 decreases the communication area between the first supply passage 41 and the second supply passage 43 to decrease the refrigerant flow at the discharge pressure Pd to the crank chamber 15, the crank chamber pressure Pc decreases because the refrigerant flow from the crank chamber 15 to the suction chamber 5*a* through the bleed passage 52 is promoted. This increases the inclination angle of the swash plate 23, thereby increasing the displacement of the compressor.

When the compressor is suspended for a relatively long time in a state that the displacement is minimal, the refrigerant gas in the crank chamber 15 may be cooled to a liquid refrigerant. This causes the suction pressure Ps of refrigerant introduced into the suction chamber 5*a* to be lower than a predetermined suction pressure and the crank chamber pressure Pc to be higher than the control pressure Pcv in the second supply passage 43 when the compressor restarts.

In this state, in the open degree adjustment valve 61, the first valve body 65 is located at the upper movement limit in the first valve chamber 71*a* and closes each suction window 73*a* as shown in FIGS. 2 and 5A. In other words, the open degree of the suction window 73*a* is minimized by the first valve body 65 when the suction pressure Ps of refrigerant introduced into the suction chamber 5*a* is lower than the predetermined suction pressure and the crank chamber pressure Pc is higher than the control pressure Pcv in the second supply passage 43. Accordingly, the first valve body 65 minimizes the communication area between the suction communication passage 50 and the first valve chamber 71*a*, thereby decreasing the open degree of the suction passage 51.

When the compressor starts, the second valve body 67 is located at the lower movement limit in the second valve chamber 71*b*, each bleed window 73*c* is fully opened by the second valve body 67, that is, the open degree of the bleed window 73*c* is maximized by the second valve body 67 when the suction pressure Ps of refrigerant introduced into the suction chamber 5*a* is lower than the predetermined suction pressure and the crank chamber pressure Pc is higher than a control pressure Pcv in the second supply passage 43. Accordingly, the second valve body 67 maximizes the communication area between the bleed communication passage 57 and the second valve chamber 71*b*, that is, the bleed passage 52 is fully opened by the second valve body 67. This allows the liquid refrigerant retained in the crank chamber 15 to quickly flow from the crank chamber 15 to the suction chamber 5*a* through the bleed communication passage 57, the second valve accommodation chamber 47*c*, the bleed window 73*c*, the second valve chamber 71*b*, the first valve chamber 71*a*, the valve communication hole 75*a*, the first valve accommodation chamber 47*b*, and the suction communication passage 50. The liquid refrigerant also flows to the suction chamber 5*a* through a clearance that is formed between the first valve chamber 71*a* and the first valve body 65 by necessity.

In the state that the first valve body 65 closes each suction window 73*a*, the open passage 73*b* is fully opened by the first valve body 65, that is, the open degree of the open passage 73*b* is maximized by the first valve body 65 when the suction pressure Ps is lower than the predetermined suction pressure and the crank chamber pressure Pc is higher than a control pressure Pcv. Accordingly, the open passage 73*b* allows the first valve chamber 71*a* to communicate with the suction communication passage 50 through the first valve accommodation chamber 47*b*. That is, the open passage 73*b* is configured to connect the first valve chamber 71*a* to the suction communication passage 50 during the startup of the compressor or when the suction pressure Ps is lower than the predetermined suction pressure. Accordingly, the liquid refrigerant, which flows from the crank chamber 15 to the first valve chamber 71*a* through the bleed communication passage 57 and the like during the startup of the compressor, is allowed to promptly flow from the first valve chamber 71*a* to the suction communication passage 50 and therefore to the suction chamber 5*a* through the open passage 73*b*. This enables the compressor to quickly decrease the crank chamber pressure Pc, therefore, it may be easy for the compressor to quickly increase the displacement of the compressor.

When the suction pressure Ps exceeds the predetermined suction pressure, the first valve body 65 starts to move toward the projecting portion 75 in the first valve chamber 71*a*. Then, the first valve body 65 starts to open the suction window 73*a* as shown in FIG. 5B, that is, the open degree of the suction window 73*a* is made greater than its minimal open degree by the first valve body 65. In other words, the open degree of the suction window 73*a* is increased by the movement of the first valve body 65 when the suction pressure Ps is higher than the predetermined suction pressure. The crank chamber pressure Pc is still higher than the control pressure Pcv in the second supply passage. In this state, the open passage 73*b* is closed by the cylindrical portion 65*a* of the first valve body 65, that is, the open degree of the open passage 73*b* is minimal. Thus, the open passage 73*b* does not connect the first valve chamber 71*a* to the suction communication passage 50 in this state. This configuration eliminates or minimizes the leakage of refrigerant through the open passage 73*b*, thereby helping the open degree adjustment valve 61 suitably maintain the pressure in the first valve chamber 71*a* and the pressure in the second valve chamber 71*b*. This configuration reduces unnecessary movement of the first valve body 65 by a damper effect of the first valve chamber 71*a* and the second valve chamber 71*b* during the minimum or relatively small displacement. As a result, in this compressor, a rate of refrigerant introduced from the evaporator into the suction chamber 5*a* is stabilized, so that the variation in the suction pressure Ps during minimum or relatively small displacement is reduced.

When the displacement of the compressor is maximal, the suction pressure Ps is higher than the predetermined suction pressure and the crank chamber pressure Pc is higher than the control pressure Pcv in the second supply passage 43. FIGS. 3 and 5C depict the open degree adjustment valve 61 in a state that the displacement of the compressor is maximal. In this state, the first valve body 65 is located at the lower movement limit in the first valve chamber 71*a* and fully opens each suction window 73*a*, that is, the open degree of the suction window 73*a* is maximized by the first valve body 65. That is, the open degree of the suction window 73*a* is increased to its maximum degree by the movement of the first valve body 65 while the suction pressure Ps is higher than the predetermined suction pressure and the crank chamber pressure Pc is higher than the control pressure Pcv in the second supply passage 43 as shown in FIGS. 5B and 5C. When the displacement of the compressor is maximal, the first valve body 65 maximizes the communication area between the suction communication passage 50 and the first valve chamber 71*a*, that is, the open degree of the suction passage 51 is increased by the first valve body 65. In this compressor, drop of the suction pressure Ps during the maximum or relatively large displacement is eliminated or minimized. The open passage 73*b* is kept closed by the first valve body 65 during the maximum displacement of the compressor.

During the maximum displacement, the second valve body 67 is located at the lower movement limit in the second valve chamber 71*b* and fully opens each bleed window 73*c*, that is, the open degree of the bleed window 73*c* is maximized by the second valve body 67 to open the bleed passage 52 when the suction pressure Ps is higher than the predetermined suction pressure and the crank chamber pressure Pc is higher than the control pressure Pcv in the second supply passage 43. Therefore, the liquid refrigerant, which may be filled in the crank chamber 15, flows to the suction chamber 5*a* through the clearance that is formed between the first valve chamber 71*a* and the first valve body 65 by necessity. The inclination angle of the swash plate 23 is maximal during the maximum displacement of the compressor, thus, the compressed refrigerant in the discharge chamber 5*b* opens the check valve 55 and flows to the condenser.

In contrast, when the displacement of the compressor is minimal, the crank chamber pressure Pc is lower than the control pressure Pcv in the second supply passage 43. FIGS. 4. and 5D depict the open degree adjustment valve 61 in the state that the displacement of the compressor is minimal. In this state, the second valve body 67 is located at the upper movement limit in the second valve chamber 71*b*. The urging spring 69 applies a load to moves the first valve body 65 to the upper movement limit in the first valve chamber 71*a*, so that the first valve body 65 is located at the upper movement limit in the first valve chamber 71*a* when the minimum displacement. The suction window 73*a* is closed by the first valve body 65. In other words, the open degree of the suction window 73*a* is decreased by the movement of the first valve body 65 when the crank chamber pressure Pc is lower than the control pressure Pcv. Accordingly, the open degree of the suction passage 51 is decreased.

During the minimum displacement of the compressor, the second valve body 67 is located at the upper movement limit in the second valve chamber 71*b* under the control pressure Pcv and closes each bleed window 73*c*. That is, the open degree of the bleed window 73*c* is minimized by the second valve body 67. In other words, the first valve body 65 and the second valve body 67 respectively start to move in the first valve chamber 71*a* and the second valve chamber 71*b* when the crank chamber pressure Pc falls below the control pressure Pcv, so that the open degree of the suction window 73*a* is decreased by the movement of the first valve body 65 and the open degree of the bleed window 73*c* is decreased by the movement of the second valve body when the crank chamber pressure Pc is lower than the control pressure Pcv as shown in FIGS. 5C and 5D. The communication area between the bleed communication passage 57 and the second valve chamber 71*b* is minimized by the second valve body 67. That is, the bleed passage 52 is closed by the second valve body 67. Accordingly, the compressor does not recompress the compressed refrigerant in the crank chamber 15 during the minimum displacement, thereby increasing the volumetric efficiency.

This configuration enables the displacement control valve 13 to quickly increase the crank chamber pressure Pc, thereby enabling the compressor to quickly change its displacement from large displacement to small displacement.

Further, the compressor of this embodiment does not need to include a bleed valve that is configured to close the bleed passage 52 as necessary in addition to the open degree adjustment valve 61. Therefore, this compressor has a small number of parts and achieves reduction of manufacturing cost and increase in the freedom of design of the compressor.

The inclination angle of the swash plate 23 is slightly greater than 0 degrees during the minimum displacement of the compressor. In this state, the compressed refrigerant in the discharge chamber 5*b* is unable to open the check valve 55 and thus does not flow to the condenser.

Accordingly, the compressor of the first embodiment ensures quietness during the minimum displacement while eliminating or minimizing drop of the suction pressure Ps during the maximum displacement. In addition, this compressor has high volumetric efficiency during the minimum displacement without increasing manufacturing cost and decreasing freedom of design of the compressor. Further, this compressor enables refrigerant such as liquid refrigerant possibly filled in the crank chamber 15 to promptly flow out of the crank chamber 15, thereby quickly increasing the displacement of the compressor during the startup of the compressor.

Specifically, in this compressor, the valve case 63 includes the cylindrical portion 63*a*, and the open passage 73*b* is formed only in the large diameter portion 631 of the cylindrical portion 63*a* of the valve case 63. This configuration facilitates making of the open passage 73*b* in this compressor.

Each suction window 73*a* has an approximately rectangular shape whose communication area decreases toward the supporting portion 63*c* as shown in FIGS. 5A to 5D. This shape enables the compressor to increase the communication area between the suction communication passage 50 and the first valve chamber 71*a* more suitably as the first valve body 65 gradually opens the suction window 73*a* as compared with a compressor that has a suction window 73*a* having a simple square shape.

This compressor has the small hole 67*c* formed in the lid portion 67*b* of the second valve body 67. The small hole 67*c* connects the communication window 73*d* to the second valve chamber 71*b*. In the open degree adjustment valve 61, the second valve body 67 moves toward the covering portion 63*b* in the second valve chamber 71*b* as the control pressure Pcv decreases. The presence of the small hole 67*c* allows the pressure in the first valve chamber 71*a* and the pressure in the second valve chamber 71*b* to be released through the small hole 67*c* with the movement of the second valve body 67. This configuration helps the movement of the second valve body 67 and increases the controllability of the second valve body 67. In the compressor of this embodiment, the presence of the small hole 67*c* in the cylindrical portion 67*a* allows refrigerant to flow from the second supply passage 43 to the second valve chamber 71*b* through the control communication passage 59, the communication window 73*d*, and the small hole 67*c* during the minimum displacement in which the crank chamber pressure Pc is lower than the control pressure Pcv. This enables the compressor to suitably maintain the pressure in the first valve chamber 71*a* and the pressure in the second valve chamber 71*b*, thereby reducing unnecessary movement of the first valve body 65 and the occurrence of suction pulsation during the minimum displacement.

The valve case 63 of the open degree adjustment valve 61 includes the projecting portion 75 disposed between the first valve chamber 71*a* and the second valve chamber 71*b*. The projecting portion 75 has an inner diameter that is smaller than an outer diameter of the second valve body 67. The first valve chamber 71*a* is connected to the second valve chamber 71*b* through the projecting portion 75. When the second valve body 67 and the first valve body 65 are respectively located at the upper movement limit in the second valve chamber 71*b* and at the upper movement limit in the first valve chamber 71*a*, the upper surface of the second valve body 67 receives a force that is obtained by multiplication of the first pressure receiving area S1 by the suction pressure Ps, and the bottom surface of the second valve body 67 receives a force that is obtained by multiplication of the second pressure receiving area S2 by the control pressure Pcv. The first pressure receiving area S1 is smaller than the second pressure receiving area S2 in the second valve body 67, so that the second valve body 67 responds sensitively to a decrease of the control pressure Pcv. Accordingly, the second valve body 67 is likely to reopen the bleed passage 52.

Second Embodiment

Figure 6:
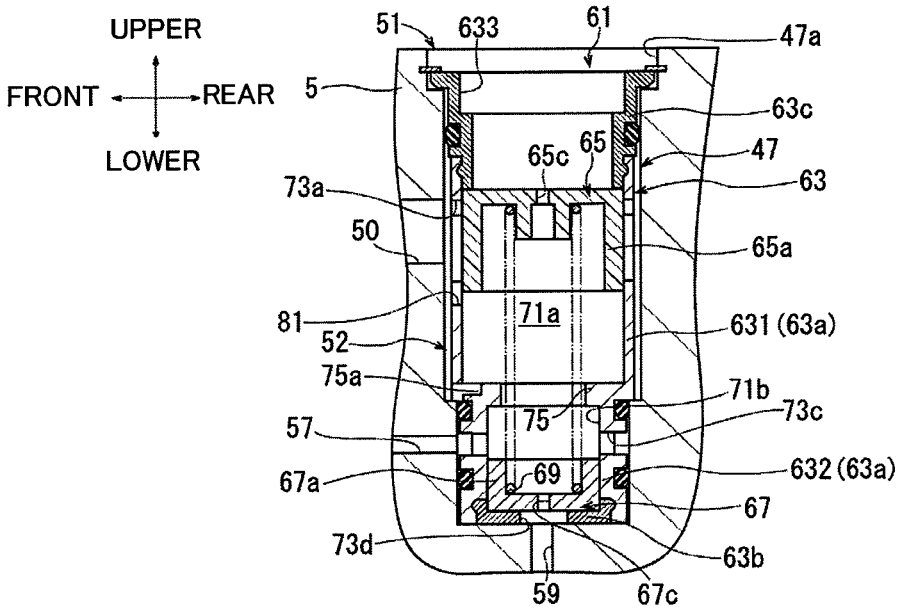
FIG. 6 is an enlarged sectional view of the main part of the compressor according to a second embodiment of the present disclosure during the startup of the compressor.
Figure 7:
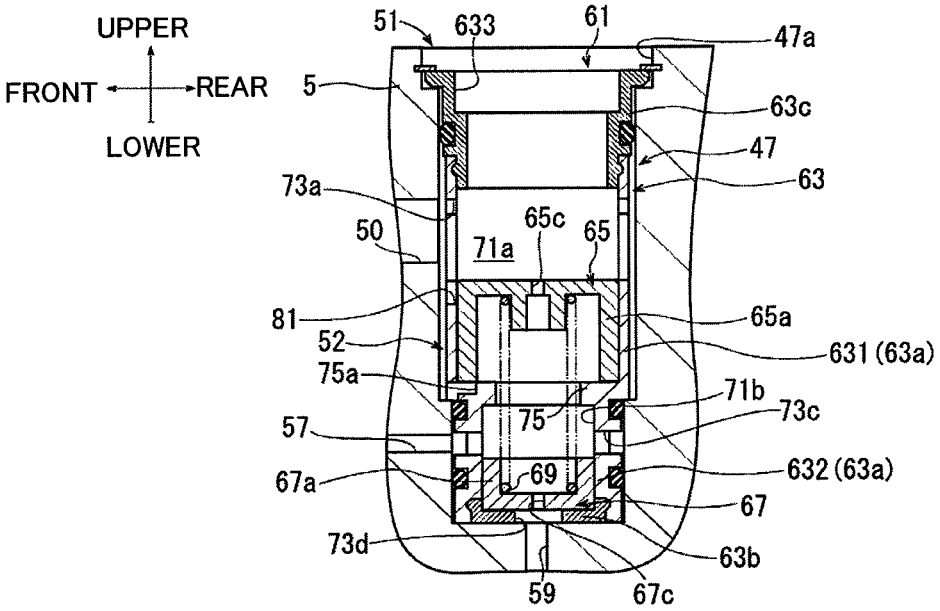
FIG. 7 is an enlarged sectional view of the main part of the compressor according to the second embodiment during the maximum displacement of the compressor.
Figure 8:
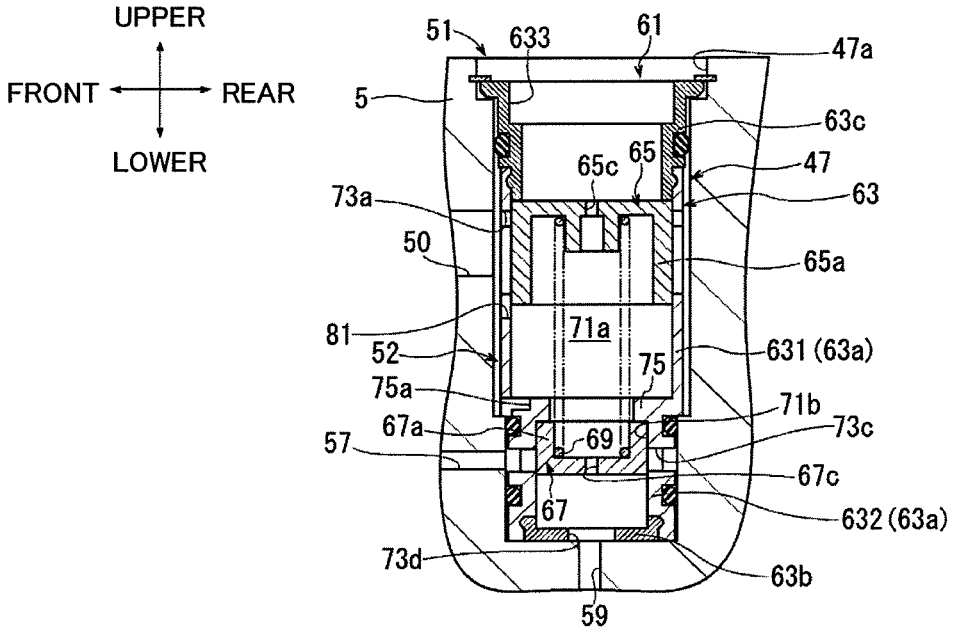
FIG. 8 is an enlarged sectional view of the main part of the compressor according to the second embodiment during the minimum displacement of the compressor.

In a compressor according to a second embodiment, the valve case 63 has a plurality of open passages 81 that are formed in the cylindrical portion 63*a* as shown in FIGS. 6 to 8, instead of the open passage 73*b* formed in the compressor according to the first embodiment.

The number of the open passages 81 corresponds to that of the suction windows 73*a*. The open passages 81 are arranged in the large diameter portion 631 of the cylindrical portion 63*a* in a circumferential direction of the large diameter portion 631. As shown in FIGS. 9A to 9D, each open passage 81 is formed continuously from a bottom of the corresponding suction window 73*a*, that is, the open passage 81 is formed integrally with the corresponding suction window 73*a* in the large diameter portion 631. The open passage 81 has an approximately triangle shape whose communication area decreases in a direction away from the suction window 73*a*. The first valve chamber 71*a* is connected to the suction communication passage 50 through the open passage 81 in the direction crossing the radial direction of the rear housing member 5. Accordingly, the open passage 81 is configured to connect the first valve chamber 71*a* to the suction communication passage 50 through the first valve accommodation chamber 47*b*. The number of the open passages 81 does not necessarily have to correspond to that of the suction windows 73*a*. Each of the open passages 81 may be formed in such a manner as to be formed integrally only with any particular suction window 73*a*. The compressor of the second embodiment is otherwise similar to the compressor of the first embodiment and will not be further elaborated here. Identical reference numerals are used to denote identical or substantially identical components between the first and the second embodiment.

In the compressor of the second embodiment, the first valve body 65 moves in the first valve chamber 71*a* in the radial direction of the rear housing member 5 to adjust the open degree of each suction window 73*a* and an open degree of each open passage 81. During the startup of the compressor, the suction pressure Ps is lower than the predetermined suction pressure and the crank chamber pressure Pc is higher than the control pressure Pcv in the second supply passage 43. In this state, as shown in FIGS. 6 and 9A, the first valve body 65 is located at the upper movement limit in the first valve chamber 71*a* and is in contact with the supporting portion 63*c*. During the minimum displacement, the crank chamber pressure Pc is lower than the control pressure Pcv in the second supply passage 43. In this state, as shown in FIGS. 8 and 9D, the first valve body 65 is also located at the upper movement limit in the first valve chamber 71*a* and is in contact with the supporting portion 63*c*. In these states, the first valve body 65 closes each suction window 73*a*, that is, the open degree of the suction window 73*a* is minimized by the first valve body 65. Also, in these states, each open passage 81 is fully opened by the cylindrical portion 65*a*, that is, the open degree of the open passage 81 is maximal. Accordingly, the open passage 81 connects the first valve chamber 71*a* to the suction communication passage 50 during the startup of the compressor and the minimum displacement of the compressor. Then, as the first valve body 65 moves toward the projecting portion 75 in the first valve chamber 71*a*, the cylindrical portion 65*a* gradually closes the open passage 81, that is, the open degree of the open passage 81 is gradually decreased by the cylindrical portion 65*a* of the first valve body 65. As shown in FIG. 9B, when the first valve body 65 starts to open the suction window 73*a*, the open passage 81 is closed by the cylindrical portion 65*a*, that is, the open degree of the open passage 81 is minimal. Accordingly, the open passage 81 does not connect the first valve chamber 71*a* to the suction communication passage 50 in this state. That is, the open degree of the open passage 81 is minimal when the open degree of the suction window 73*a* is made greater than its minimum open degree by the first valve body 65.

During the maximum displacement, the suction pressure Ps is higher than the predetermined suction pressure and the crank chamber pressure Pc is higher than the control pressure Pcv in the second supply passage 43. In this state, as shown in FIGS. 7 and 9C, each suction window 73*a* is fully opened by the first valve body 65, that is, the open degree of the suction window 73*a* is maximized by the first valve body 65. During the maximum displacement, each open passage 81 is kept closed by the cylindrical portion 65*a* of the first valve body 65. The second valve body 67 of the second embodiment opens and closes each bleed window 73*c* in the same manner as the second valve body 67 of the first embodiment does, so that the compressor of the second embodiment operates in the same manner as the compressor of the first embodiment does.

The compressor of the second embodiment has the plurality of open passages 81. This configuration allows the liquid refrigerant, which flows from the crank chamber 15 to the first valve chamber 71*a* through the bleed communication passage 57 and the like, to promptly flow from the first valve chamber 71*a* to the suction chamber 5*a* through the open passages 81 during the startup of the compressor.

Third Embodiment

In a compressor according to a third embodiment, the valve case 63 has a plurality of open passages 83 that is formed in the cylindrical portion 63*a* of the valve case 63 as shown in FIGS. 10A to 10D, instead of the open passage 73*b* that is formed in the compressor according to the first embodiment.

The number of the open passages 83 corresponds to that of the suction windows 73*a*. The open passages 83 are arranged in the large diameter portion 631 of the cylindrical portion 63*a* in a circumferential direction of the large diameter portion 631 such that each open passage 83 is formed continuously from a bottom edge of the corresponding suction window 73*a* and has a rectangular shape extending toward the second valve chamber 71*b* in the radial direction of the rear housing member 5. That is, each open passage 83 is formed integrally with the corresponding suction window 73*a* in the large diameter portion 631. As well as the open passages 81 of the second embodiment, the first valve chamber 71*a* is connected to the suction communication passage 50 through the open passages 83 in the direction crossing the radial direction of the rear housing member 5. Accordingly, each open passage 83 is configured to connect the first valve chamber 71*a* to the suction communication passage 50 through the first valve accommodation chamber 47*b*. The number of the open passages 83 does not necessarily have to correspond to that of the suction windows 73*a*. Each open passage 83 may be formed in such a manner as to be formed integrally only with any particular suction window 73*a*. The compressor according to the third embodiment is otherwise similar to the compressor according to the first embodiment and will not be further elaborated here.

In the compressor of the third embodiment, as shown in FIGS. 10A and 10D, each suction window 73*a* is closed by the first valve body 65 during the startup and the minimum displacement of the compressor, that is, the open degree of the suction window 73*a* is minimized by the first valve body 65. In this state, each open passage 83 is fully opened by the cylindrical portion 65*a* of the first valve body 65, that is, the open degree of the open passage 83 is maximized by the cylindrical portion 65*a*. Accordingly, the open passage 83 connects the first valve chamber 71*a* to the suction communication passage 50 during the startup of the compressor and the minimum displacement of the compressor. Then, as the first valve body 65 moves toward the projecting portion 75 in the first valve chamber 71*a*, the cylindrical portion 65*a* gradually closes the open passage 83, that is, the open degree of the open passage 83 is gradually decreased by the cylindrical portion 65*a*. As shown in FIG. 10B, when the first valve body 65 starts to open the suction window 73*a*, each open passage 83 is closed by the cylindrical portion 65*a* of the first valve body 65, that is, the open degree of the open passage 83 is minimized by the first valve body 65. Accordingly, the open passage 83 does not connect the first valve chamber 71*a* to the suction communication passage 50 in this state. That is, the open degree of the open passage 83 is minimal when the open degree of the suction window 73*a* is made greater than its minimum open degree by the first valve body 65.

During the maximum displacement, as shown in FIG. 10C, each suction window 73*a* is fully opened by the first valve body 65, that is, the open degree of the suction window 73*a* is maximized by the first valve body 65. In this state, each open passage 83 is kept closed by the cylindrical portion 65*a*. The second valve body 67 of the third embodiment opens and closes each bleed window 73*c* in the same manner as the second valve body 67 of the first embodiment does, so that the compressor of the third embodiment operates in the same manner as the compressor of the first embodiment does.

Fourth Embodiment

In a compressor according to a fourth embodiment, the first valve body 65 has a plurality of open passages 65*e*. The open passages 65*e* are arranged in a bottom part of the cylindrical portion 65*a* of the first valve body 65 in a circumferential direction of the cylindrical portion 65*a* as shown in FIGS. 11 to 14. Each open passage 65*e* has a triangle shape whose communication area increases from an approximately middle of the cylindrical portion 65*a* toward the bottom end of the cylindrical portion 65*a*. In this embodiment, as the first valve body 65 moves in the first valve chamber 71*a*, the open passage 65*e* comes close to and away from each suction window 73*a*. The open passage 65*e* allows the first valve chamber 71*a* to be connected to the suction communication passage 50 through the suction window 73*a*. Accordingly, the open passage 65*e* is configured to connect the first valve chamber 71*a* to the suction communication passage 50 through the suction window 73*a* and the first valve accommodation chamber 47*b*. The compressor of the fourth embodiment is different from the compressor of the first embodiment in that the cylindrical portion 63*a* of the valve case 63 of the fourth embodiment does not have the open passage 73*b*. The number of the open passages 65*e* may be determined as necessary. The compressor according to the fourth embodiment is otherwise similar to the compressor according to the first embodiment.

Figure 11:
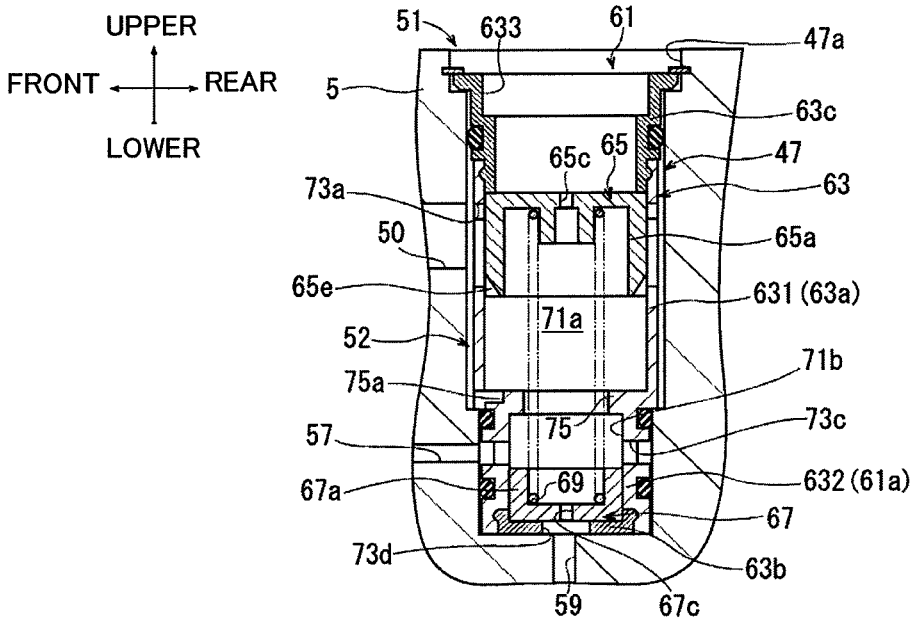
FIG. 11 is an enlarged sectional view of the main part of the compressor according to a fourth embodiment during the startup of the compressor.
Figure 12:
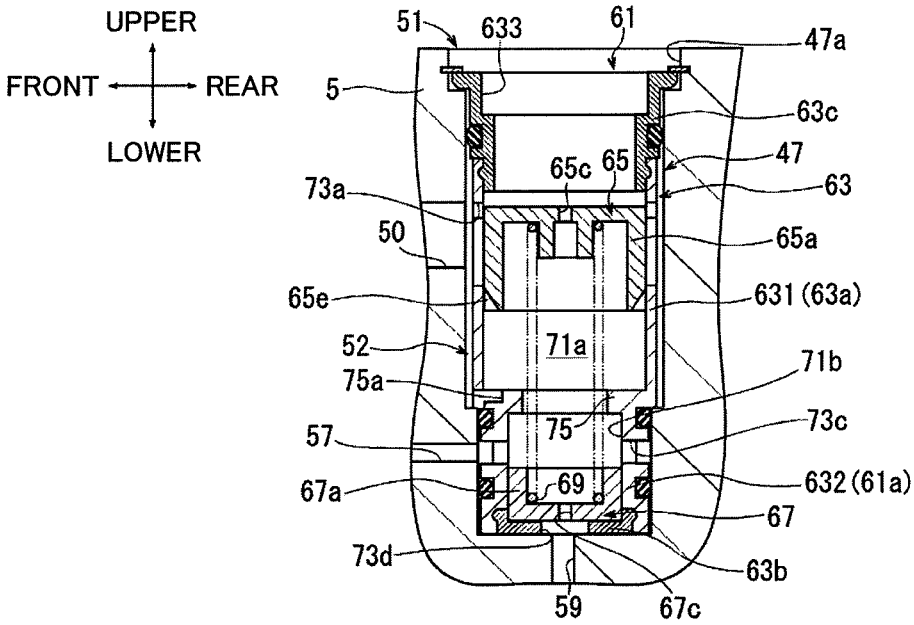
FIG. 12 is an enlarged sectional view of the main part of the compressor according to the fourth embodiment when the first valve body starts to open the suction windows.

In the compressor of the fourth embodiment, as shown in FIG. 11, the first valve body 65 is located at the upper movement limit in the first valve chamber 71*a* and closes each suction window 73*a* during the startup of the compressor, that is, the open degree of the suction window 73*a* is minimized by the first valve body 65. In this state, each open passage 65*e* comes closest to the suction window 73*a*, so that a communication area between the open passage 65*e* and the suction window 73*a* is maximized, that is, an open degree of the open passage 65*e* is maximal in this state. Accordingly, the open passage 65*e* allows the first valve chamber 71*a* to communicate with the suction communication passage 50 in this state. Then, as the first valve body 65 moves toward the projecting portion 75 in the first valve chamber 71*a*, the open passage 65*e* gradually comes away from the suction window 73*a*. The communication area between the open passage 65*e* and the suction window 73*a* gradually decreases, thus, the open degree of the open passage 65*e* is gradually decreased. As shown in FIG. 12, when the first valve body 65 starts to open the suction window 73*a*, the open passage 65*e* is closed by an inner peripheral surface of the large diameter portion 631 and thus disconnected from the suction window 73*a*. Accordingly, the open degree of the open passage 65*e* is minimal, so that the open passage 65*e* does not connect the first valve chamber 71*a* to the suction communication passage 50.

Figure 13:
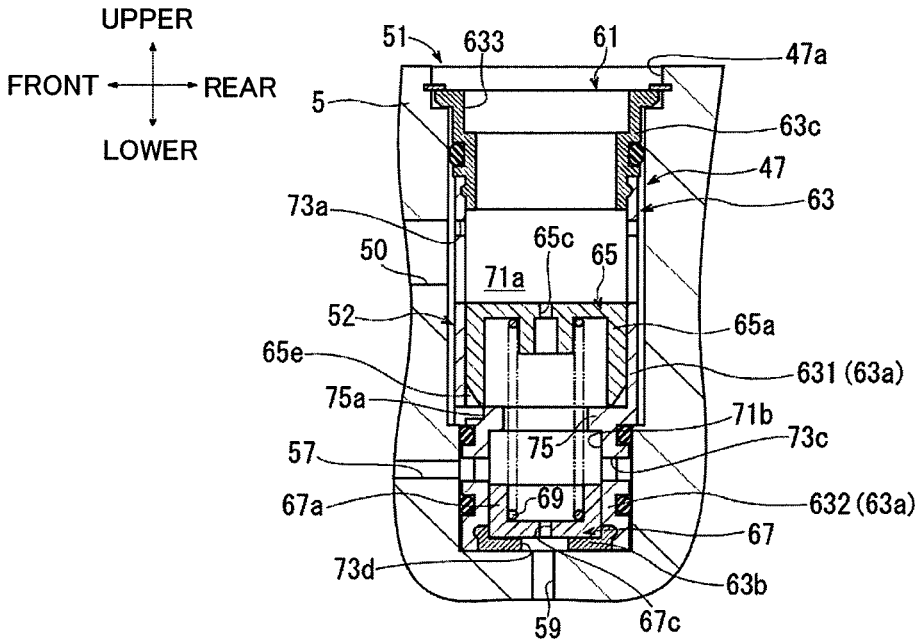
FIG. 13 is an enlarged sectional view of the main part of the compressor according to the fourth embodiment during the maximum displacement of the compressor.
Figure 14:
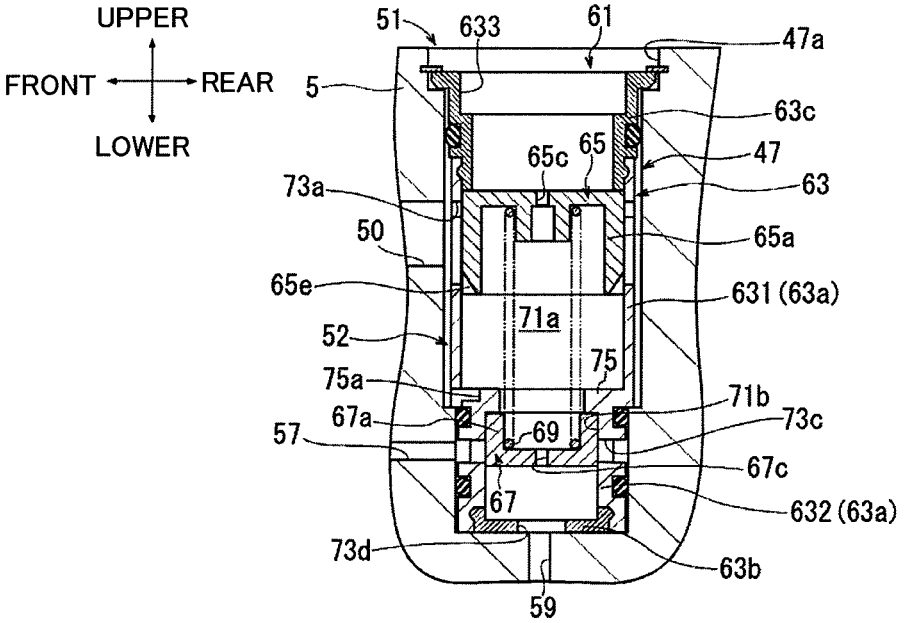
FIG. 14 is an enlarged sectional view of the main part of the compressor according to the fourth embodiment during the minimum displacement of the compressor.

During the maximum displacement, as shown in FIG. 13, each suction window 73*a* is fully opened by the first valve body 65, that is, the open degree of the suction window 73*a* is maximized by the first valve body 65. In this state, the open passage 65*e* is kept closed by the inner peripheral surface of the large diameter portion 631. In contrast, during the minimum displacement, as shown in FIG. 14, the first valve body 65 is located at the upper movement limit in the first valve chamber 71*a* and the open passage 65*e* comes closest to the suction window 73*a*, so that the open degree of the open passage 65*e* is maximal. In this state, the second valve body 67 is located at the upper movement limit in the second valve chamber 71*b*. The second valve body 67 of the fourth embodiment opens and closes each bleed window 73*c* in the same manner as the second valve body 67 of the first embodiment does, so that the compressor of the fourth embodiment operates in the same manner as the compressor of the first embodiment does.

In this compressor, the open passage 65*e* is formed only in the cylindrical portion 65*a* of the first valve body 65. This configuration facilitates making of the open passage 65*e* in this compressor.

The above-described embodiments are examples and are not intended to limit the scope of the present disclosure. The present disclosure may be modified within the scope of the present disclosure.

For example, in the compressors according to the first to the fourth embodiment, the bleed passage 52 is opened and closed only by the second valve body 67; however, the compressor may be configured such that the bleed passage 52 is opened and closed by the first valve body 65 and the second valve body 67.

The compressors according to the first to the fourth embodiment include the displacement control valve 13 that is configured to adjust the communication area between the first supply passage 41 and the second supply passage 43; however, the compressor may include a displacement control valve that is configured to adjust a communication area of a bleed passage in conjunction with adjusting a communication area of a supply passage.

The open passage 65*e* may be formed in the cylindrical portion 65*a* of the first valve body 65 in addition to the open passage 73*b*, the open passages 81, or the open passages 83 formed in the cylindrical portion 63*a* of the valve case 63.

In the compressor of the first embodiment, the open degree of the open passage 73*b* is minimal when the first valve body 65 starts to open each suction window 73*a*, that is, the open degree of the open passage 73*b* is minimal when the open degree of the suction window 73*a* is made greater than the minimum open degree of the suction window 73*a* by the first valve body 65. However, the open degree of the open passage 73*b* does not necessarily have to be minimal in this state. The compressor may be configured such that the open degree of the open passage 73*b* is greater than its minimal open degree but smaller than its maximal open degree when the first valve body 65 starts to open the suction window 73*a*. This is applicable to the compressors of the second to the fourth embodiment.

The present disclosure is applicable to any type of air conditioners including an air conditioner for vehicles.

What is claimed is:

1. A variable displacement swash plate type compressor comprising:

a housing having a suction chamber, a cylinder bore, a crank chamber, and a discharge chamber;

a swash plate disposed in the crank chamber, an inclination angle of the swash plate being changed depending on a crank chamber pressure in the crank chamber;

a piston disposed in the cylinder bore and cooperating with the housing to form therebetween a compression chamber, the piston being configured to reciprocate in the cylinder bore at a stroke depending on the inclination angle of the swash plate to draw refrigerant from the suction chamber into the compression chamber to compress the refrigerant in the compression chamber, the piston being configured to discharge the compressed refrigerant from the compression chamber to the discharge chamber;

a displacement control valve disposed in the housing and configured to adjust the crank chamber pressure; and an open degree adjustment valve disposed in the housing and configured to at least adjust a rate of refrigerant that is introduced into the suction chamber, wherein the housing further has a suction passage configured to connect the suction chamber to a refrigerant circuit outside the variable displacement swash plate type compressor, a first supply passage configured to connect the discharge chamber to the displacement control valve, a second supply passage configured to connect the displacement control valve to the crank chamber, a bleed passage configured to connect the crank chamber to the suction chamber, a suction communication passage configured to connect the suction chamber to the open degree adjustment valve, a bleed communication passage configured to connect the crank chamber to the open degree adjustment valve, and a control communication passage configured to connect the second supply passage to the open degree adjustment valve, the open degree adjustment valve includes a valve case, a first valve body, a second valve body, and an urging spring, wherein the valve case has:

a suction port opening to the refrigerant circuit;

a first valve chamber having a cylindrical shape and extending in a first direction;

a second valve chamber having a cylindrical shape and formed coaxially with the first valve chamber, the second valve chamber being configured to communicate with the first valve chamber;

a suction window through which the first valve chamber is connected to the suction communication passage in a second direction crossing the first direction;

a bleed window through which the second valve chamber is connected to the bleed communication passage in the second direction; and a communication window through which the second valve chamber is connected to the control communication passage in the first direction, the first valve body is accommodated in the first valve chamber and is movable in the first valve chamber in the first direction to adjust an open degree of the suction window, the second valve body is accommodated in the second valve chamber and is movable in the second valve chamber in the first direction to adjust an open degree of the bleed window, the urging spring is disposed between the first valve body and the second valve body and connects the first valve body to the second valve body, the open degree of the suction window is minimized by the first valve body and the open degree of the bleed window is maximized by the second valve body when a suction pressure of refrigerant introduced into the suction chamber is lower than a predetermined suction pressure and the crank chamber pressure is higher than a control pressure in the second supply passage, the open degree of the suction window is increased by a movement of the first valve body and the open degree of the bleed window is maximized by the second valve body when the suction pressure is higher than the predetermined suction pressure and the crank chamber pressure is higher than the control pressure, the open degree of the suction window is decreased by the movement of the first valve body and the open degree of the bleed window is decreased by a movement of the second valve body when the crank chamber pressure is lower than the control pressure, at least one of the valve case and the first valve body has an open passage that is configured to connect a space of the first valve chamber in which the urging spring of the first valve body is disposed to the suction communication passage, an open degree of the open passage is maximal when the suction pressure is lower than the predetermined suction pressure and the crank chamber pressure is higher than the control pressure, the open degree of the open passage is minimal when the open degree of the suction window is made greater than a minimum open degree of the suction window by the first valve body, and wherein the open passage is formed separately from the bleed window.

2. The variable displacement swash plate type compressor according to claim 1, wherein the open passage is formed only in the valve case and formed separately from the suction window.

3. The variable displacement swash plate type compressor according to claim 1, wherein the open passage is formed only in the valve case and formed integrally with the suction window.

4. The variable displacement swash plate type compressor according to claim 1, wherein the open passage is formed only in the first valve body.

5. The variable displacement swash plate type compressor according to claim 1, wherein the second valve body has a small hole that connects the communication window to the second valve chamber.

6. The variable displacement swash plate type compressor according to claim 1, wherein a width of the open passage in a circumferential direction of the valve case is smaller than a width of the suction window in the circumferential direction of the valve case.

7. The variable displacement swash plate type compressor according to claim 6, wherein the first valve body includes a cylindrical portion and a lid portion, and the open passage is formed in a surface of the first valve chamber on which the cylindrical portion slides.

* * * * *